US006986658B2

(12) United States Patent
Stephens et al.

(10) Patent No.: US 6,986,658 B2
(45) Date of Patent: Jan. 17, 2006

(54) BURNER EMPLOYING STEAM INJECTION

(75) Inventors: George Stephens, Humble, TX (US); David B. Spicer, Houston, TX (US)

(73) Assignee: ExxonMobil Chemical Patents, Inc., Houston, TX (US)

( * ) Notice: Subject to any disclaimer, the term of this patent is extended or adjusted under 35 U.S.C. 154(b) by 131 days.

(21) Appl. No.: 10/389,038

(22) Filed: Mar. 14, 2003

(65) Prior Publication Data

US 2003/0175640 A1 Sep. 18, 2003

Related U.S. Application Data

(60) Provisional application No. 60/365,226, filed on Mar. 16, 2002.

(51) Int. Cl.
*F23M 3/04* (2006.01)
*F23L 7/00* (2006.01)

(52) U.S. Cl. ..... 431/115; 431/9; 431/116; 431/190

(58) Field of Classification Search ..... 431/115, 431/116, 9, 190, 174, 181, 187, 173, 188
See application file for complete search history.

(56) References Cited

U.S. PATENT DOCUMENTS

| | | | | |
|---|---|---|---|---|
| 2,368,370 A | 1/1945 | Maxon | ..... | 158/7 |
| 2,813,578 A | 11/1957 | Ferguson | ..... | 158/1 |
| 2,918,117 A | 12/1959 | Griffin | ..... | 158/1 |
| 2,983,312 A | 5/1961 | Finley et al. | ..... | 158/79 |
| 3,880,570 A | 4/1975 | Marshall | ..... | 431/4 |

(Continued)

FOREIGN PATENT DOCUMENTS

| | | |
|---|---|---|
| CA | 1169753 | 6/1984 |
| DE | 2944153 | 5/1981 |
| DE | 3232421 | 3/1984 |
| DE | 3818265 | 11/1989 |
| EP | 0099828 | 6/1988 |

(Continued)

OTHER PUBLICATIONS

Chemical Engineering Progress, vol. 43, 1947, "The Design of Jet Pumps" by A. Edgar Kroll, pp. 21–24, vol. 1, No. 2.
Straitz III, John F., et al., "Combat NOx With Better Burner Design," *Chemical Engineering*, Nov. 1994, pp. EE–4–EE–8.
Vahdati, M. M., et al., "Design And Development of A Low NOx Coanda Ejector Burner," *Journal of the Institute of Energy*, Mar. 2000, vol. 73, pp. 12–17.
Bussman, Wes, et al., "Low NOx Burner Technology for Ethylene Cracking Furnaces," presented at the *2001 ALChE Spring National Meeting, 13th Annual Ethylene Producers Conference*, Houston, TX, Apr. 25, 2001, pp. 1–23.
Seebold, James G., "Reduce Heater NOx in the Burner," *Hydrocarbon Processing*, Nov. 1982, pp. 183–186.
"West Germany's Caloric Develops a Low–NOx Recycling Fuel Burner," *Chemical Engineering*, Oct. 4, 1982, p. 17.

*Primary Examiner*—James C. Yeung
(74) *Attorney, Agent, or Firm*—Lucinda Lomas; Linda A. Kuhena

(57) ABSTRACT

Method and apparatus for use in burners of furnaces such as those used in steam cracking. The apparatus includes a burner tube having a downstream end and an upstream end for receiving fuel and air, flue gas or mixtures thereof. A burner tip is mounted on the downstream end of the burner tube adjacent a first opening in the furnace, so that combustion of the fuel takes place downstream of the burner tip. At least one passageway has a first end at a second opening in the furnace and a second end in a primary air chamber adjacent the upstream end of the burner tube. The passageway also has structure for injecting steam into the passageway and a means for drawing flue gas from the furnace through the passageway.

21 Claims, 7 Drawing Sheets

U.S. PATENT DOCUMENTS

| | | | | |
|---|---|---|---|---|
| 4,004,875 | A | 1/1977 | Zink et al. | 431/9 |
| 4,089,629 | A | 5/1978 | Baumgartner et al. | 431/9 |
| 4,130,388 | A | 12/1978 | Flanagan | 431/116 |
| 4,230,445 | A | 10/1980 | Janssen | 431/116 |
| 4,257,763 | A | 3/1981 | Reed | 431/188 |
| 4,575,332 | A | 3/1986 | Oppenberg et al. | 431/9 |
| 4,629,413 | A | 12/1986 | Michelson et al. | 431/116 |
| 4,708,638 | A | 11/1987 | Brazier et al. | 431/116 |
| 4,739,713 | A | 4/1988 | Vier et al. | 110/263 |
| 4,748,919 | A | 6/1988 | Campobenedetto et al. | 110/264 |
| 4,815,966 | A | 3/1989 | Janssen | 431/174 |
| 4,828,483 | A | 5/1989 | Finke | 431/11 |
| 4,963,089 | A | 10/1990 | Spielman | 431/351 |
| 4,995,807 | A | 2/1991 | Rampley et al. | 431/9 |
| 5,044,931 | A | 9/1991 | Van Eerden et al. | 431/8 |
| 5,073,105 | A | 12/1991 | Martin et al. | 431/116 |
| 5,092,761 | A | 3/1992 | Dinicolantonio | 431/115 |
| 5,098,282 | A | 3/1992 | Schwartz et al. | 431/9 |
| 5,135,387 | A | 8/1992 | Martin et al. | 431/116 |
| 5,152,463 | A | 10/1992 | Mao et al. | 239/402 |
| 5,154,596 | A | 10/1992 | Schwartz et al. | 431/9 |
| 5,195,884 | A | 3/1993 | Schwartz et al. | 431/8 |
| 5,201,650 | A | 4/1993 | Johnson | 431/9 |
| 5,224,851 | A | 7/1993 | Johnson | 431/115 |
| 5,238,395 | A | 8/1993 | Schwartz et al. | 431/10 |
| 5,254,325 | A | 10/1993 | Yamasaki et al. | 423/450 |
| 5,263,849 | A | 11/1993 | Irwin et al. | 431/6 |
| 5,269,679 | A | 12/1993 | Syska et al. | 431/9 |
| 5,275,554 | A | 1/1994 | Faulkner | 431/115 |
| 5,284,438 | A | 2/1994 | McGill et al. | 431/9 |
| 5,299,930 | A | 4/1994 | Weidman | 431/10 |
| 5,316,469 | A | 5/1994 | Martin et al. | 431/116 |
| 5,326,254 | A | 7/1994 | Munk | 431/115 |
| 5,344,307 | A | 9/1994 | Schwartz et al. | 431/9 |
| 5,350,293 | A | 9/1994 | Khinkis et al. | 431/116 |
| 5,370,526 | A | 12/1994 | Buschulte et al. | 431/116 |
| 5,407,345 | A | 4/1995 | Robertson et al. | 431/115 |
| 5,413,477 | A | 5/1995 | Moreland | 431/9 |
| 5,470,224 | A | 11/1995 | Bortz | 431/182 |
| 5,472,341 | A | 12/1995 | Meeks | 431/243 |
| 5,542,839 | A | 8/1996 | Kelly | 431/10 |
| 5,562,438 | A | 10/1996 | Gordon et al. | 431/115 |
| 5,584,684 | A | 12/1996 | Dobbeling et al. | 431/285 |
| 5,603,906 | A | 2/1997 | Lang et al. | 422/182 |
| 5,611,682 | A | 3/1997 | Slavejkov et al. | 431/8 |
| 5,624,253 | A | 4/1997 | Sulzhik et al. | 431/116 |
| 5,685,707 | A | 11/1997 | Ramsdell et al. | 431/90 |
| 5,688,115 | A | 11/1997 | Johnson | 431/9 |
| 5,807,094 | A | 9/1998 | Sarv | 431/177 |
| 5,813,846 | A | 9/1998 | Newby et al. | 431/9 |
| 5,980,243 | A | 11/1999 | Surbey et al. | 431/347 |
| 5,984,665 | A | 11/1999 | Loftus et al. | 431/116 |
| 5,987,875 | A | 11/1999 | Hilburn et al. | 60/39.05 |
| 5,993,193 | A | 11/1999 | Loftus et al. | 431/8 |
| 6,007,325 | A | 12/1999 | Loftus et al. | 431/8 |
| 6,056,538 | A | 5/2000 | Büchner et al. | 431/115 |
| 6,332,408 | B2 | 12/2001 | Howlett et al. | 110/189 |
| 6,347,935 | B1 * | 2/2002 | Schindler et al. | 431/5 |
| 6,383,462 | B1 | 5/2002 | Lang | 423/235 |
| 6,616,442 | B2 | 9/2003 | Venizelos et al. | 431/8 |

FOREIGN PATENT DOCUMENTS

| | | |
|---|---|---|
| EP | 0 347 956 | 12/1989 |
| EP | 0 374 423 | 6/1990 |
| EP | 0 408 171 A1 | 1/1991 |
| EP | 507 233 A2 | 7/1992 |
| EP | 0 620 402 A1 | 10/1994 |
| EP | 0 674 135 B2 | 9/1995 |
| EP | 0 751 343 | 1/1997 |
| EP | 0486169 | 1/1998 |
| EP | 1096202 | 2/2001 |
| FR | 2629900 | 10/1988 |
| RU | 374488 | 3/1973 |

* cited by examiner

BURNER EMPLOYING STEAM INJECTION

RELATED APPLICATIONS

This patent application claims priority from Provisional Application Serial No. 60/365,226, filed on Mar. 16, 2002, the contents of which are hereby incorporated by reference.

FIELD OF THE INVENTION

This invention relates to an improvement in a burner such as those employed in high temperature furnaces in the steam cracking of hydrocarbons. More particularly, it relates to the use of steam to provide a more homogeneous mixture of flue gas, steam and air entering a fuel-gas-recirculation (FGR) burner to achieve a reduction in $NO_x$ emissions.

BACKGROUND OF THE INVENTION

As a result of the interest in recent years to reduce the emission of pollutants from burners used in large industrial furnaces, burner design has undergone substantial change. In the past, improvements in burner design were aimed primarily at improving heat distribution. Increasingly stringent environmental regulations have shifted the focus of burner design to the minimization of regulated pollutants.

Oxides of nitrogen ($NO_x$) are formed in air at high temperatures. Reduction of $NO_x$ emissions is a desired goal to decrease air pollution and meet government regulations. In recent years, a wide variety of mobile and stationary sources of $NO_x$ emissions have come under increased scrutiny and regulation.

A strategy for achieving lower $NO_x$ emission levels is to install a $NO_x$ reduction catalyst to treat the furnace exhaust stream. This strategy, known as Selective Catalytic Reduction (SCR), is very costly and, although it can be effective in meeting more stringent regulations, represents a less desirable alternative to improvements in burner design.

Burners used in large industrial furnaces may use either liquid fuel or gas. Liquid fuel burners mix the fuel with steam prior to combustion to atomize the fuel to enable more complete combustion, and combustion air is mixed with the fuel at the zone of combustion.

Gas fired burners can be classified as either premix or raw gas, depending on the method used to combine the air and fuel. They also differ in configuration and the type of burner tip used.

Raw gas burners inject fuel directly into the air stream, and the mixing of fuel and air occurs simultaneously with combustion. Since airflow does not change appreciably with fuel flow, the air register settings of natural draft burners must be changed after firing rate changes. Therefore, frequent adjustment may be necessary, as explained in detail in U.S. Pat. No. 4,257,763, which patent is incorporated herein by reference. In addition, many raw gas burners produce luminous flames.

Premix burners mix some or all of the fuel with some or all of the combustion air prior to combustion. Since premixing is accomplished by using the energy present in the fuel stream, airflow is largely proportional to fuel flow. As a result, therefore, less frequent adjustment is required. Premixing the fuel and air also facilitates the achievement of the desired flame characteristics. Due to these properties, premix burners are often compatible with various steam cracking furnace configurations.

Floor-fired premix burners are used in many steam crackers and steam reformers primarily because of their ability to produce a relatively uniform heat distribution profile in the tall radiant sections of these furnaces. Flames are non-luminous, permitting tube metal temperatures to be readily monitored. Therefore, a premix burner is the burner of choice for such furnaces. Premix burners can also be designed for special heat distribution profiles or flame shapes required in other types of furnaces.

In gas fired industrial furnaces $NO_x$ is formed by the oxidation of nitrogen drawn into the burner with the combustion air stream. The formation of $NO_x$ is widely believed to occur primarily in regions of the flame where there exist both high temperatures and an abundance of oxygen. Since ethylene furnaces are amongst the highest temperature furnaces used in the hydrocarbon processing industry, the natural tendency of burners in these furnaces is to produce high levels of $NO_x$ emissions.

One technique for reducing $NO_x$ that has become widely accepted in industry is known as staging. With staging, the primary flame zone is deficient in either air (fuel rich) or fuel (fuel lean). The balance of the air or fuel is injected into the burner in a secondary flame zone or elsewhere in the combustion chamber. As is well known, a fuel-rich or fuel-lean combustion zone is less conducive to $NO_x$ formation than an air-fuel ratio closer to stoichiometry. Staging results in reducing peak temperatures in the primary flame zone and has been found to alter combustion speed in a way that reduces $NO_x$. Since $NO_x$ formation is exponentially dependent on gas temperature, even small reductions in peak flame temperature dramatically reduce $NO_x$ emissions. However this must be balanced with the fact that radiant heat transfer decreases with reduced flame temperature, while CO emissions, an indication of incomplete combustion, may actually increase as well.

In the context of premix burners, the term primary air refers to the air premixed with the fuel; secondary, and in some cases tertiary, air refers to the balance of the air required for proper combustion. In raw gas burners, primary air is the air that is more closely associated with the fuel; secondary and tertiary air are more remotely associated with the fuel. The upper limit of flammability refers to the mixture containing the maximum fuel concentration (fuel-rich) through which a flame can propagate.

Thus, one set of techniques achieves lower flame temperatures by using staged-air or staged-fuel burners to lower flame temperatures by carrying out the initial combustion at far from stoichiometric conditions (either fuel-rich or air-rich) and adding the remaining air or fuel only after the flame has radiated some heat away to the fluid being heated in the furnace.

Another set of techniques achieves lower flame temperatures by diluting the fuel-air mixture with inert material. Flue-gas (the products of the combustion reaction) or steam are commonly used diluents. Such burners are classified as FGR (flue-gas-recirculation) or steam-injected, respectively.

U.S. Pat. No. 5,092,761 discloses a method and apparatus for reducing $NO_x$ emissions from premix burners by recirculating flue gas. Flue gas is drawn from the furnace through a pipe or pipes by the aspirating effect of fuel gas and combustion air passing through a venturi portion of a burner tube. The flue gas mixes with combustion air in a primary air chamber prior to combustion to dilute the concentration of $O_2$ in the combustion air, which lowers flame temperature and thereby reduces $NO_x$ emissions. The contents of U.S. Pat. No. 5,092,761 are incorporated herein by reference.

Burners of the type disclosed in U.S. Pat. No. 5,092,761 have optionally employed steam injection for the primary purpose of providing a motive force for enhancing the flow of recirculated flue gas, fuel gas, air and steam into the burner tube located in the primary chamber at the base of the burner.

Analysis of burners of the type described in U.S. Pat. No. 5,092,761 has indicated the flue-gas-recirculation (FGR) ratio is generally in the range 5–10% where FGR ratio is defined as:

$$FGR \text{ ratio } (\%)=100[G/(F+A)]$$

where G=Flue-gas drawn into venturi, (Ib)

F=Fuel combusted in burner, (Ib), and

A=Air drawn into burner, (Ib).

The ability of these burners to generate higher FGR ratios is limited by the inspirating capacity of the gas spud/venturi/FGR flow ducting combination. Further closing of the primary air dampers will produce lower pressures in the primary air chamber and thus enable increased FGR ratios.

Despite these advances in the art, a need exists for a burner having a desirable heat distribution profile that meets increasingly stringent $NO_x$ emission regulations.

Therefore, what is needed is a burner for the combustion of fuel gas wherein the temperature of the fuel and air, flue-gas or mixtures thereof is advantageously reduced and which also enables higher flue gas recirculation ratios (FGR) to be utilized, yielding further reductions in $NO_x$ emissions.

SUMMARY OF THE INVENTION

The present invention is directed to a method and apparatus for use in burners of furnaces such as those used in steam cracking. In accordance with a broad aspect of the invention, there is provided an apparatus comprising a furnace having a first opening, and a burner located adjacent the first opening in said furnace. The burner has (i) a primary air chamber, and (ii) a burner tube including a downstream end, an upstream end for receiving fuel and air, flue gas or mixtures thereof from said primary air chamber, and a burner tip mounted on the downstream end of the burner tube adjacent the first opening in the furnace for combusting the fuel downstream of the burner tip. At least one passageway is provided with a first end at a second opening in the furnace and a second end in a primary air chamber adjacent the upstream end of the burner tube. The passageway is provided with means for injecting steam into the passageway. Means are provided for drawing flue gas from the furnace through the passageway and air from a source of air in response to an inspirating effect created by uncombusted fuel. The fuel and air flowing through the burner tube from its upstream end towards its downstream end creates the means for drawing flue gas and air.

In accordance with another broad aspect of the present invention, a method is provided that includes the steps of combining fuel and air, flue gas or mixtures thereof at a predetermined location; passing the fuel and air, flue gas or mixtures thereof through a venturi; combusting the fuel at a combustion zone downstream of the venturi; drawing flue gas from the furnace through at least one passageway to a primary air chamber containing said predetermined location and injecting steam into said at least one passageway.

The injection of steam into the stream of flue gas before the flue gas mixes with the air results in a more homogenous mixture of flue gas, steam, and air entering the burner. A more homogeneous mixture results in higher venturi capacity, higher flue gas entrainment capacity, lower peak flame temperature and lower $NO_x$. This location also tends to reduce the temperature of the passageway, which extends its life.

An object of the present invention is to provide a burner arrangement that permits the temperature of the fuel/air/flue-gas mixture in the venturi to be reduced, thus reducing $NO_x$ emissions.

These and other objects and features of the present invention will be apparent from the detailed description taken with reference to accompanying drawings.

BRIEF DESCRIPTION OF THE DRAWINGS

The invention is further explained in the description that follows with reference to the drawings illustrating, by way of non-limiting examples, various embodiments of the invention wherein.

DETAILED DESCRIPTION OF THE PREFERRED EMBODIMENTS

Although the present invention is described in terms of a burner for use in connection with a furnace or an industrial furnace, it will be apparent to one of skill in the art that the teachings of the present invention also have applicability to other process components such as, for example, boilers. Thus, the term furnace herein shall be understood to mean furnaces, boilers and other applicable process components.

Figure 1:
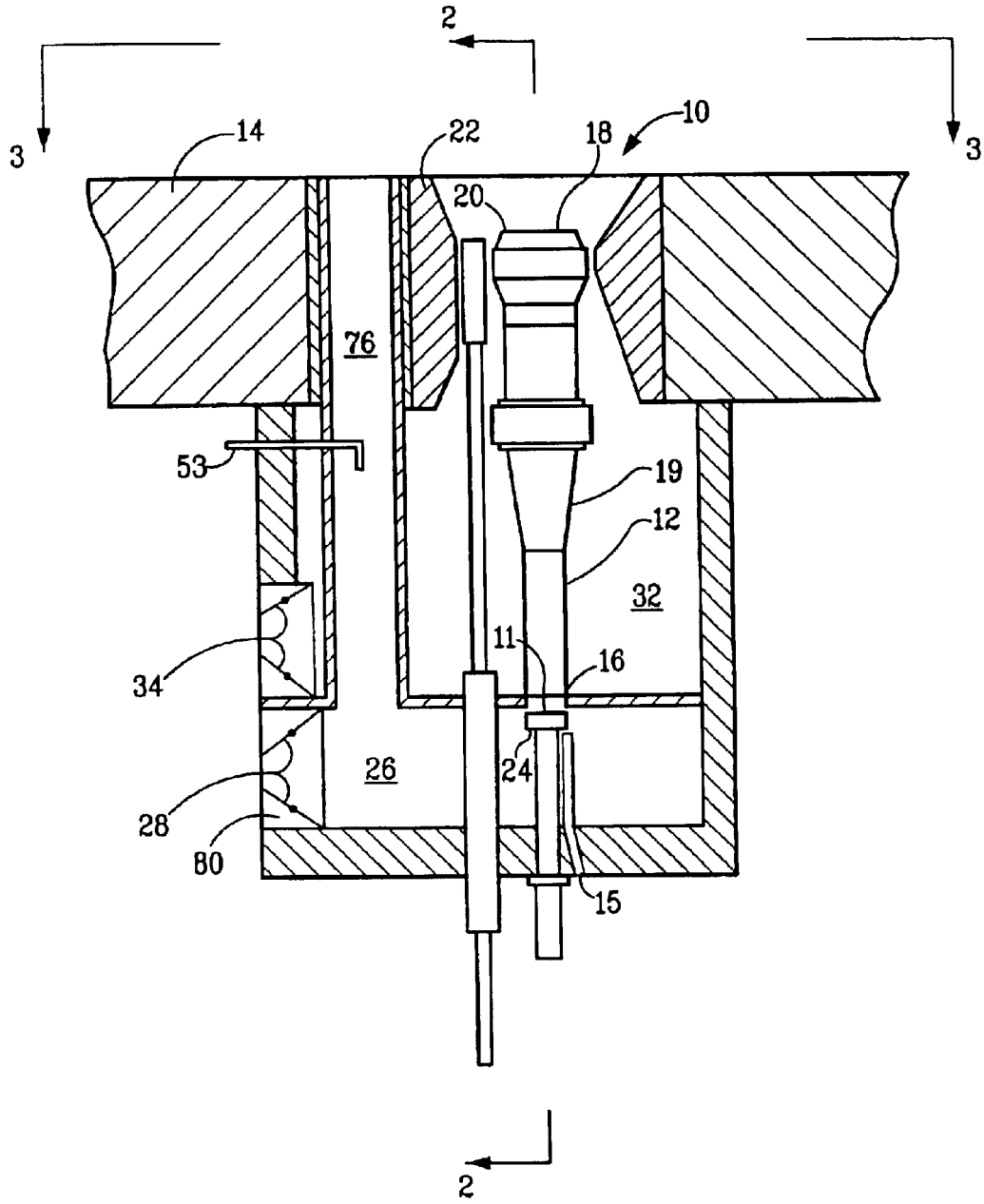
FIG. 1 illustrates an elevation partly in section of an embodiment of the burner of the present invention.
Figure 2:
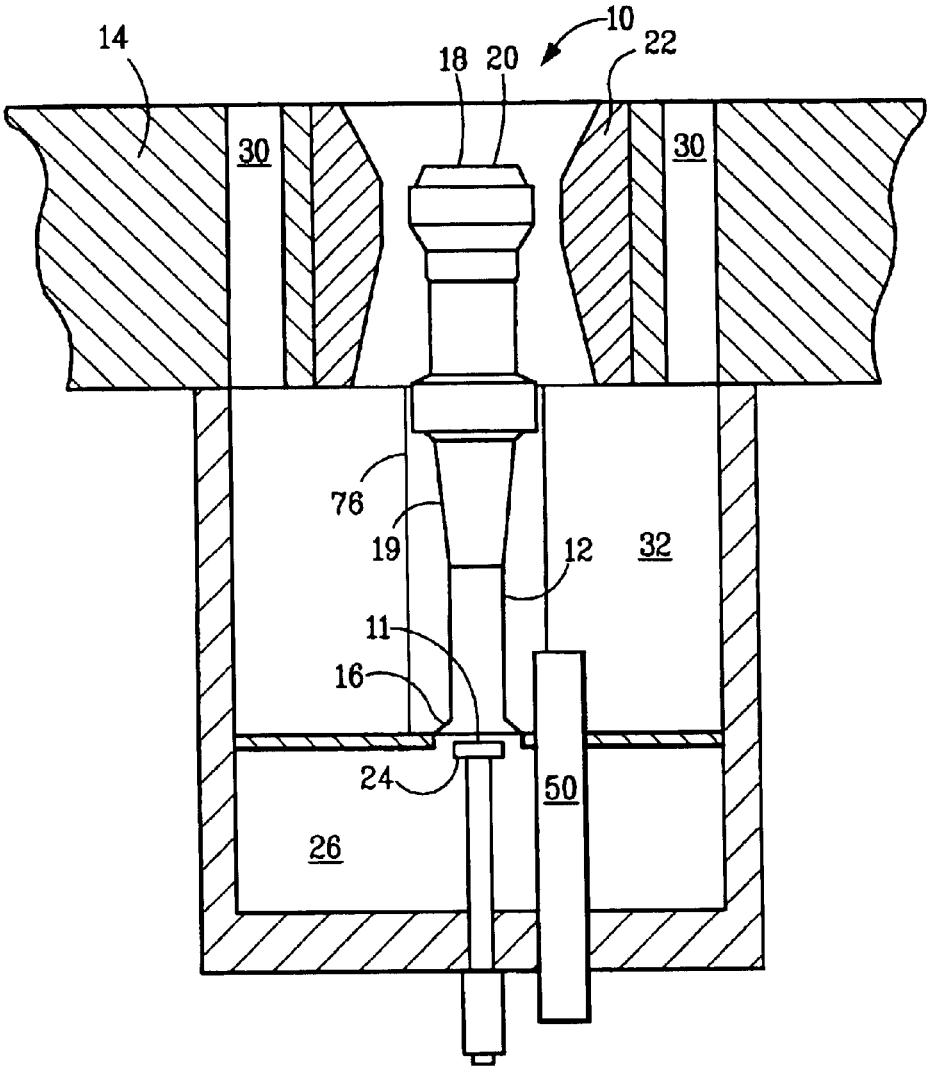
FIG. 2 is an elevation partly in section taken along line 2—2 of FIG. 1.
Figure 3:
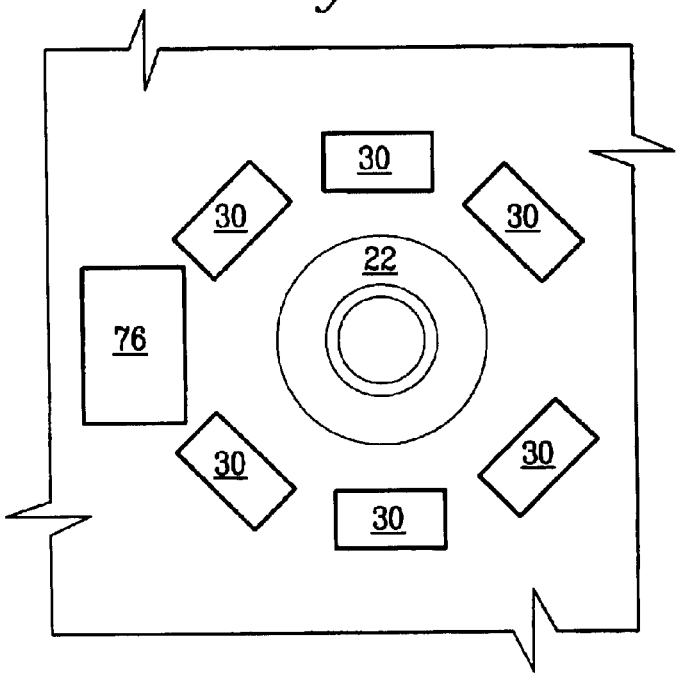
FIG. 3 is a plan view taken along line 3—3 of FIG. 1.

Referring particularly to FIGS. 1–3, a burner 10 includes a freestanding burner tube 12 located in a well in a furnace floor 14. The burner tube 12 includes an upstream end 16, a downstream end 18 and a venturi portion 19. A burner tip 20 is located at the downstream end 18 and is surrounded by an annular tile 22. A fuel orifice 11, which may be located in gas spud 24, is located at the upstream end 16 and introduces fuel into the burner tube 12. Fresh or ambient air is introduced into a primary air chamber 26 through an adjustable damper 28 to mix with the fuel at the upstream end 16 of the burner tube 12 and pass upwardly through the venturi portion 19. Combustion of the fuel and fresh air occurs downstream of burner tip 20. Optionally, one or more steam injection tubes 15 may be provided so as to be positioned in the direction of flow so as to add to the motive force provided by venturi portion 19 for inducing the flow of fuel, steam and flue gas, air and mixtures thereof into the burner tube 12.

A plurality of air ports 30 (FIGS. 2 and 3) originate in a secondary air chamber 32 and pass through the furnace floor 14 into the furnace. Fresh or ambient air enters the secondary air chamber 32 through adjustable dampers 34 and passes through the staged air ports 30 into the furnace to provide secondary or staged combustion, as described in U.S. Pat. No. 4,629,413, which is hereby incorporated herein by reference.

Unmixed low temperature fresh or ambient air, having entered the secondary air chamber 32 through the dampers 34 and having passed through the air ports 30 into the furnace, is also drawn through a passageway 76 into a primary air chamber 26 by the inspirating effect of the fuel passing through the venturi portion 19. The passageway 76 is shown as a metallic FGR duct.

U.S. Pat. No. 5,092,761 contemplates locating a steam injection point(s) at the base of the venturi for the purpose of reducing $NO_x$. This is also known as de$NO_x$ steam injection. In accordance with an aspect of the present invention, means for injecting steam in the form of de$NO_x$ steam injection tube(s) 53 are located in the passageway 76 upstream of the air source 80. This location results in a more homogenous combination of flue gas, steam, air or mixtures thereof and air entering the burner venturi 19. A more homogeneous mixture can result in higher venturi capacity, higher flue gas entrainment capacity, lower flame temperature and lower $NO_x$. This location also tends to reduce the temperature of the metallic FGR duct, which extends the life of the duct.

Lighting port 50 provides access to the interior of burner 10 for lighting element (not shown).

Flue gas containing, for example, about 0 to about 15% $O_2$ is drawn from near the furnace floor through the passageway 76 with about 5 to about 15% $O_2$ preferred, about 2 to about 10% $O_2$ more preferred and about 2 to about 5% $O_2$ particularly preferred, by the inspirating effect of fuel passing through venturi portion 19 of burner tube 12. In this manner, the primary air and flue gas are mixed in primary air chamber 26, which is prior to the zone of combustion. Therefore, the amount of inert material mixed with the fuel is raised, thereby reducing the flame temperature and, as a result, reducing $NO_x$ emissions. This is in contrast to a liquid fuel burner, such as that of U.S. Pat. No. 2,813,578, in which the combustion air is mixed with the fuel at the zone of combustion, rather than prior to the zone of combustion.

Closing or partially closing damper 28 restricts the amount of fresh air that can be drawn into the primary air chamber 26 and thereby provides the vacuum necessary to draw flue gas from the furnace floor.

Advantageously, a mixture of about 50% flue gas and from about 50% ambient air should be drawn through the passageway 76. The desired proportions of flue gas and ambient air may be achieved by proper placement and/or design of the passageway 76 in relation to the air ports 30. That is, the geometry of the air ports, including but not limited to their distance from the burner tube, the number of air ports, and the size of the air ports, may be varied to obtain the desired percentages of flue gas and ambient air.

Figure 4:
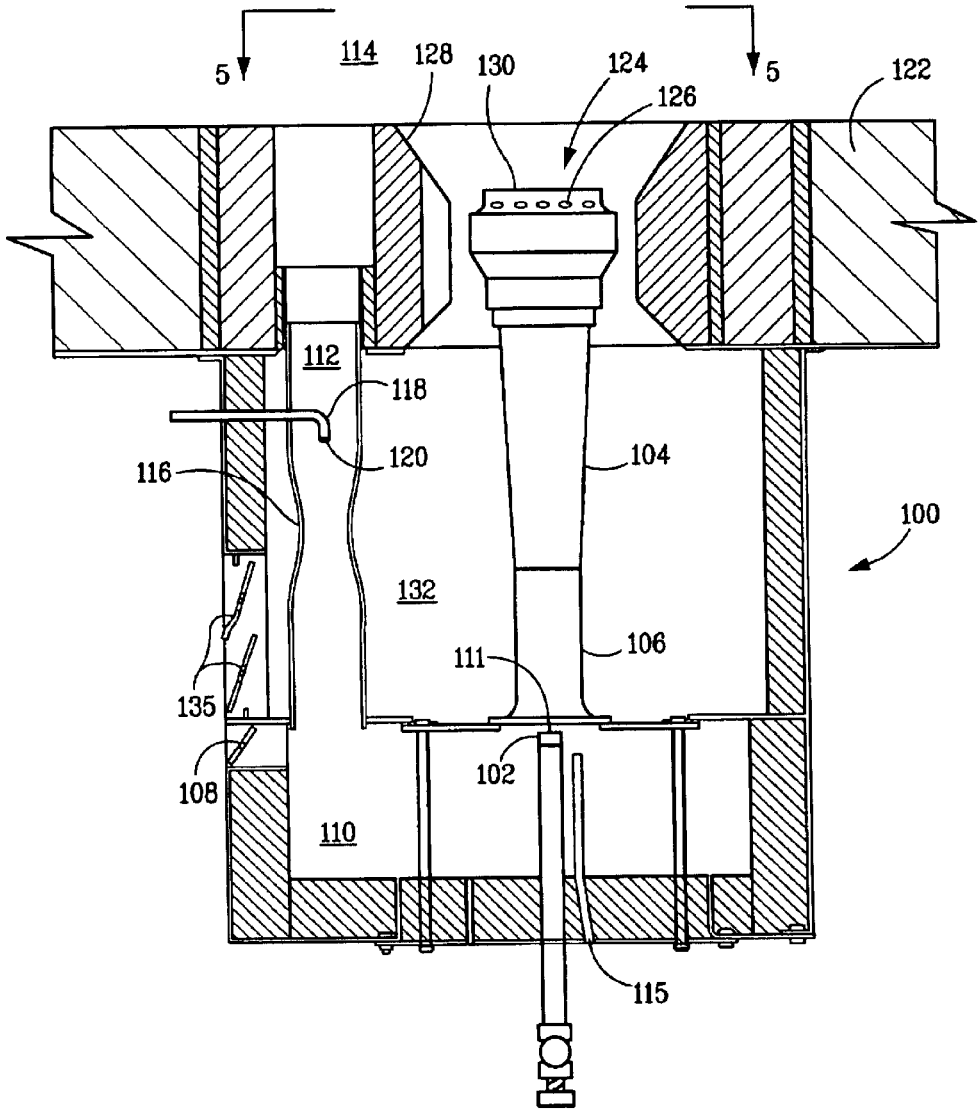
FIG. 4 is a schematic illustration of another embodiment of the burner of the present invention.

FIG. 4 illustrates another embodiment of the invention for using steam injection to enhance the flue gas recirculation ratio of a burner 100. With reference to FIG. 4, fuel exits a fuel orifice 111, which may be located within gas spud 102, at a high velocity at the entrance to a venturi portion 104 of a burner tube 106, thus inspirating air from a primary air chamber 110 into the venturi portion 104. Partially closing the primary air dampers 108 generates a sub-ambient pressure in the primary air chamber 110. A flue gas recirculation (FGR) duct 112 connects the furnace 114 to the primary air chamber 110 of the burner 100, thus permitting the flow of the flue gas into the primary air chamber 110 to be mixed with fuel from the fuel orifice 111, which may be located within gas spud 102 and primary air from the dampers 108. The flue gas recirculation duct 112 has a venturi section 116. Steam for $NO_x$ reduction is injected at the entrance of the venturi section 116 through an orifice, which may be located within spud 120 of steam injection tube 118, for generating a high velocity steam jet at the entrance to venturi section 116. The steam jet/venturi combination inspirates flue gas from the floor 122 of the furnace 114 into the primary air chamber 110 of the burner 100. With this arrangement, the pressure in the primary air chamber 110 does not need to be reduced as far below ambient as does the burner of U.S. Pat. No. 5,092,761, the mixture of flue gas, air and steam is more homogeneous and a greater volume of flue gas can be recycled, providing higher FGR ratios and lower $NO_x$ emissions, while still maintaining sufficient primary air flow to assure good burner stability.

Optionally, one or more steam injection tubes 115 may be provided and positioned in the direction of flow so as to add to the motive force provided by venturi portion 104 for inducing the flow of fuel, steam and flue gas, air and mixtures thereof into the burner tube 106.

Figure 5:
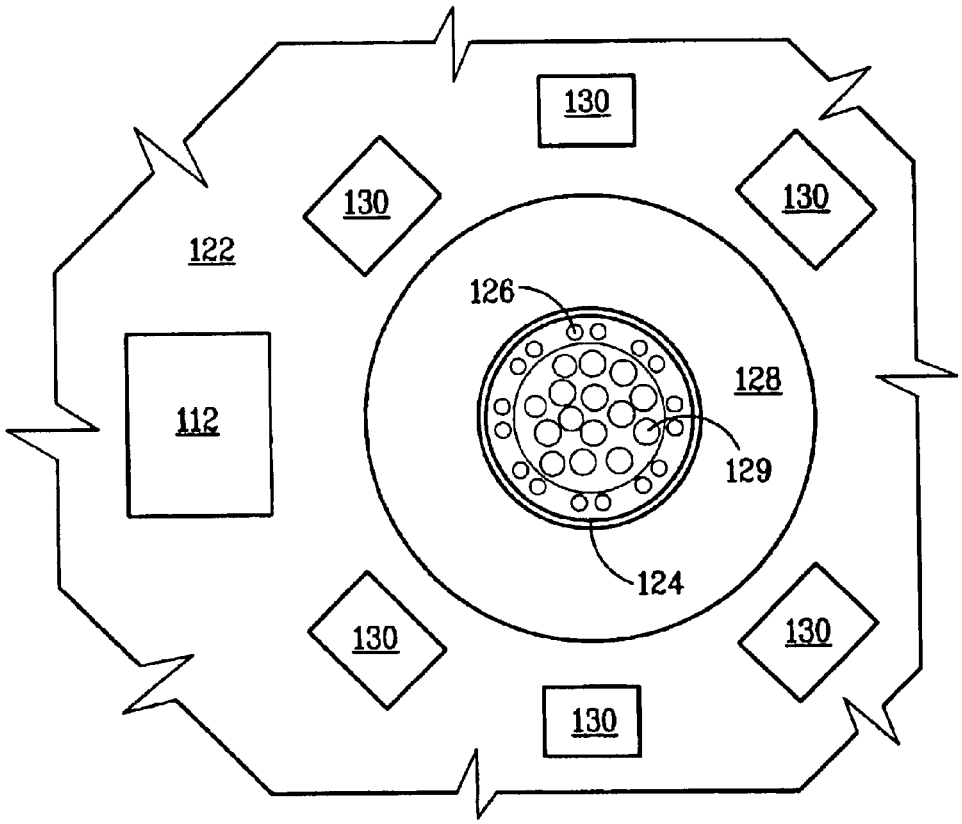
FIG. 5 is a plan view taken along line 5—5 of FIG. 4.

Referring to FIGS. 4 and 5, a plurality of staged air ports 130 originate in a secondary air chamber 132 and pass through the furnace floor 122 into the furnace 114. Fresh or ambient air enters the secondary air chamber 132 through adjustable dampers 135 and passes through the staged air ports 130 into the furnace 114 to provide secondary or staged combustion.

Figure 7:
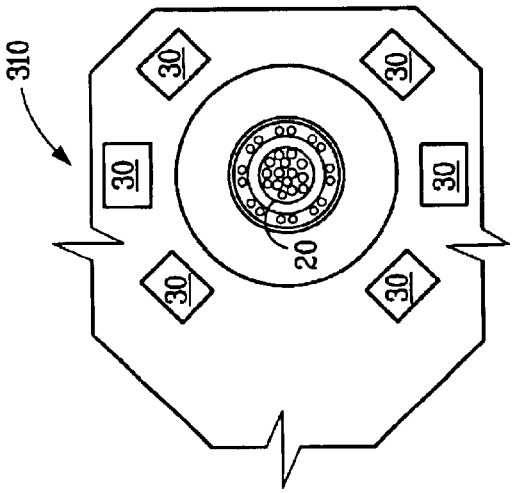
FIG. 7 is a plan view of an embodiment of the present invention employing external FGR.
Figure 6:
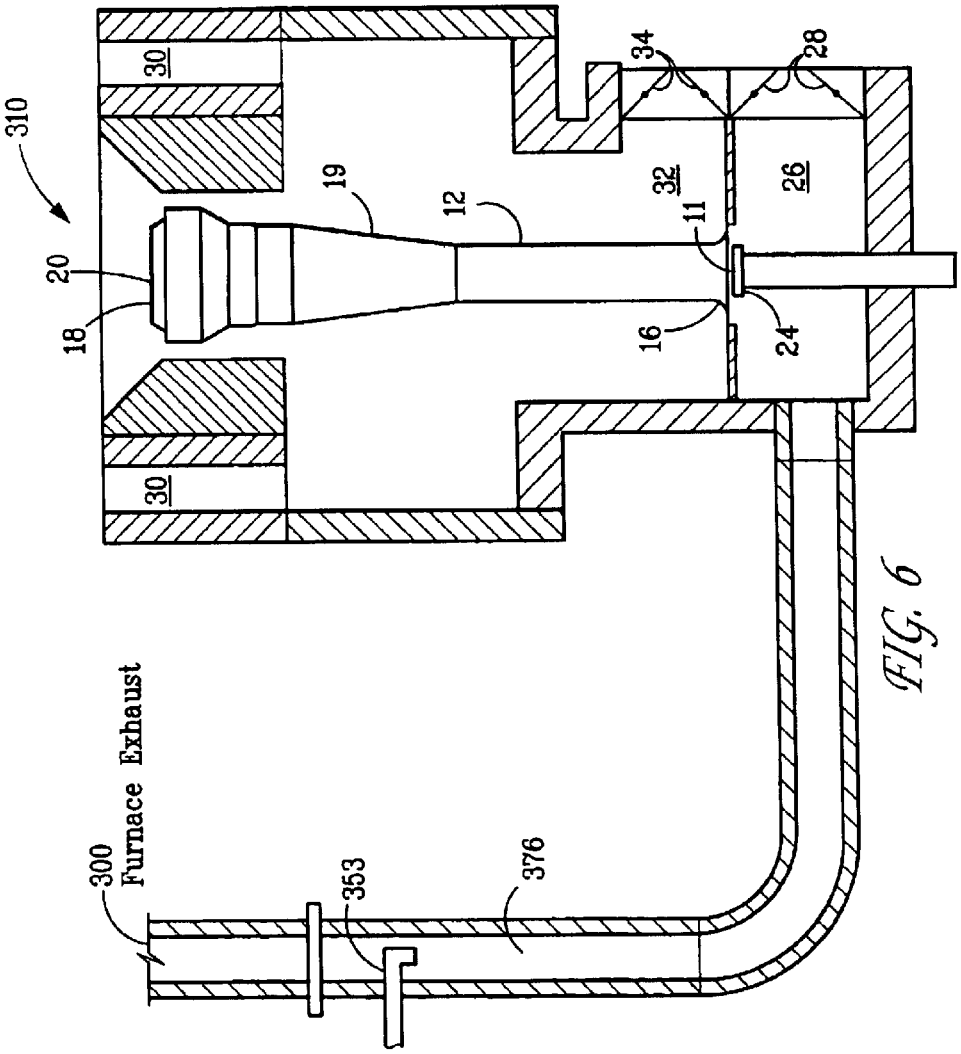
FIG. 6 is an elevation view of an embodiment of the present invention employing external FGR.

Referring to FIGS. 6 and 7, another embodiment of the present invention is illustrated. In this embodiment, the teachings above with respect to the steam injection techniques of the present invention may be applied in connection with a furnace having one or more burners utilizing an external FGR duct 376 in fluid communication with a furnace exhaust 300. It will be understood by one of skill in the art that several burners 310 are located within the furnace, all of which feed furnace exhaust 300 and external FGR duct 376. In this case, steam injection tube(s) 353 are located in the passageway 376 upstream of the primary air dampers 28. The benefit of the present invention serves to increase the motive force available to draw flue gas through FGR duct 376, eliminating or minimizing the need for an external fan to supply adequate levels of FGR.

Figure 8:
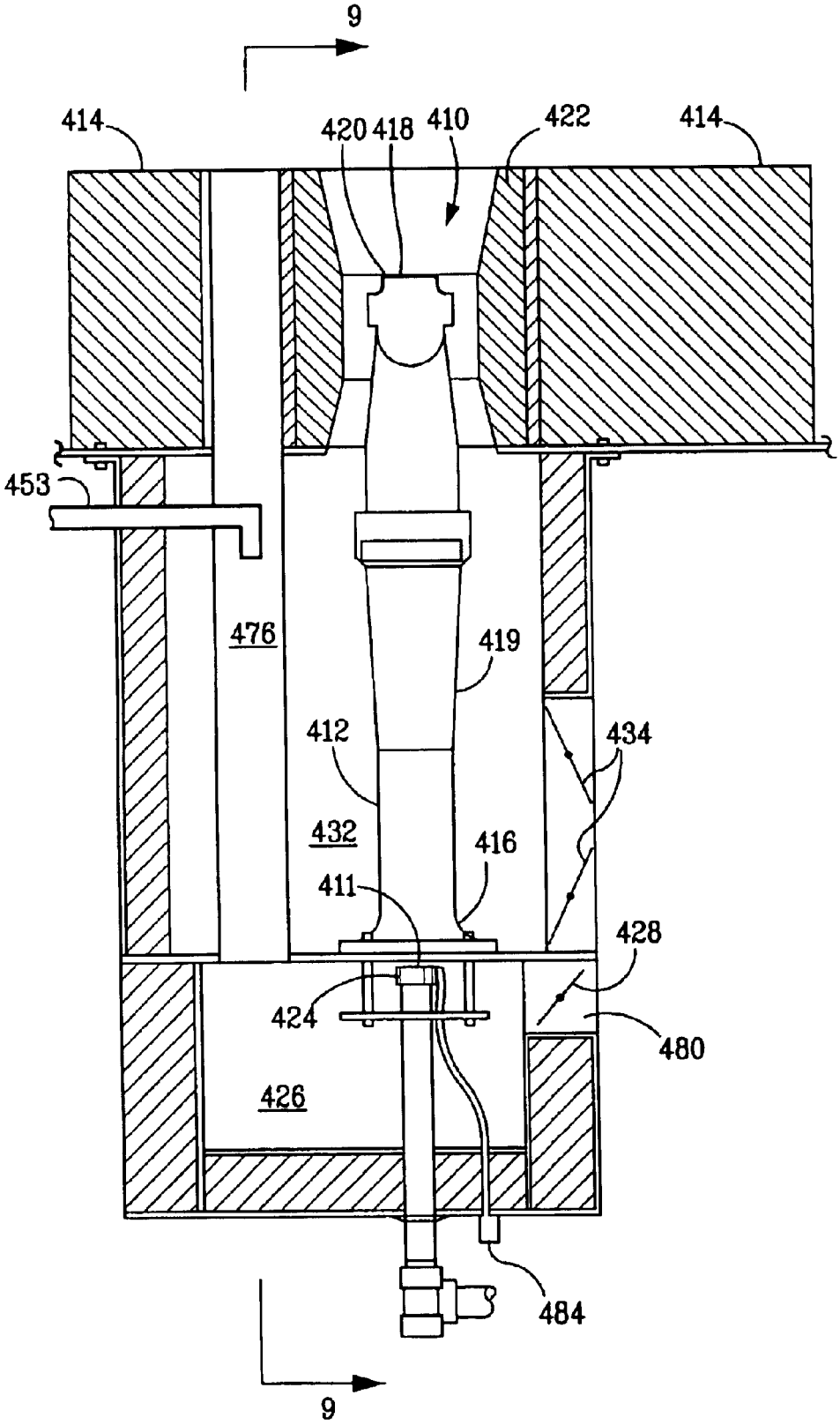
FIG. 8 illustrates an elevation partly in section of an embodiment of a flat-flame burner of the present invention.
Figure 9:
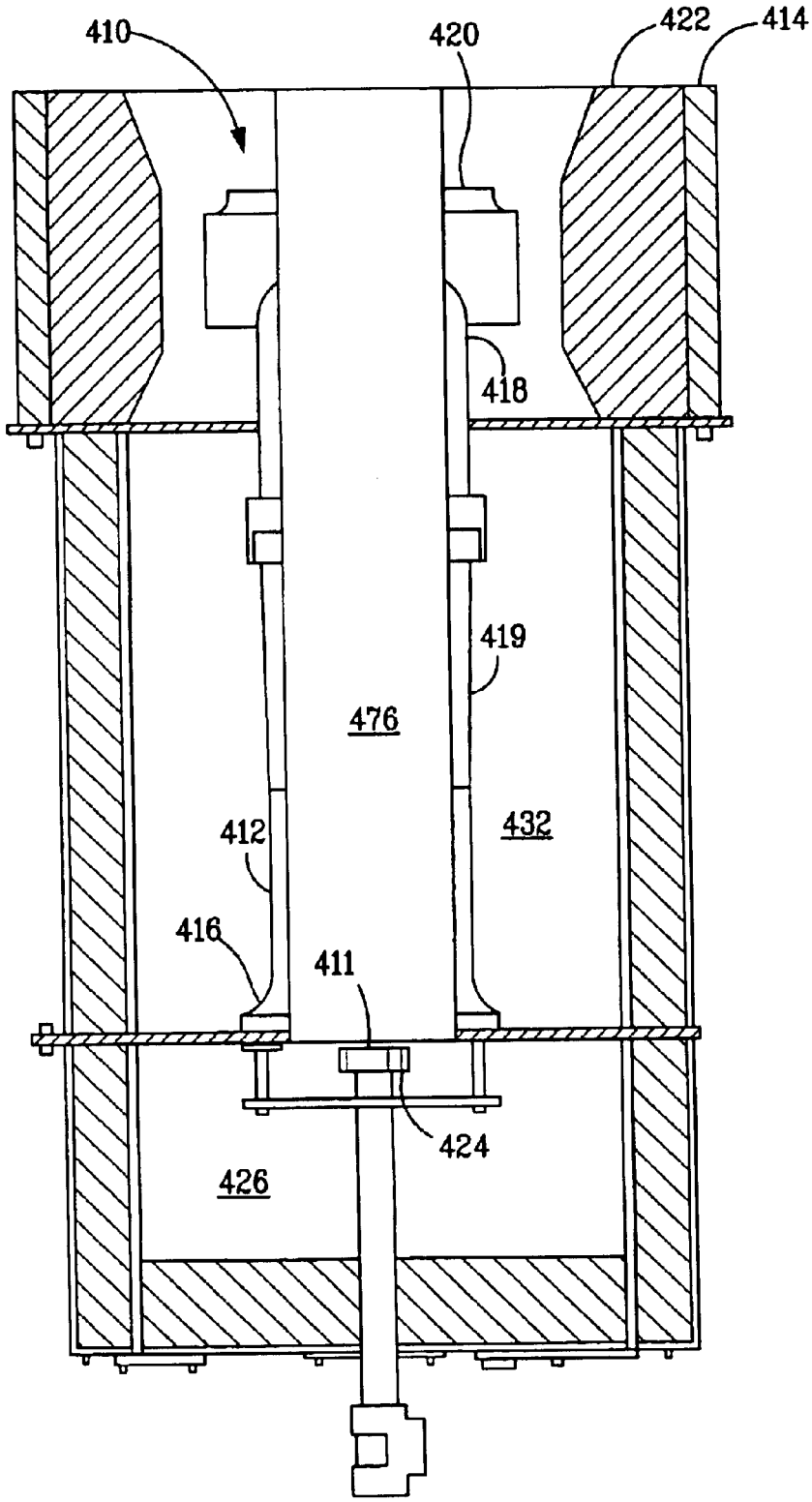
FIG. 9 is an elevation partly in section of the embodiment of a flat-flame burner of FIG. 8 taken along line 9—9 of FIG. 8.

Benefits similar to those described above through the use of the steam injection techniques of the present invention can be achieved in flat-flame burners, as will now be described by reference to FIGS. 8 and 9.

A burner 410 includes a freestanding burner tube 412 located in a well in a furnace floor 414. Burner tube 412 includes an upstream end 416, a downstream end 418 and a venturi portion 419. Burner tip 420 is located at downstream end 418 and is surrounded by a peripheral tile 422. A fuel orifice 411, which may be located in gas spud 424, is located at upstream end 416 and introduces fuel into burner tube 412. Fresh or ambient air may be introduced into primary air chamber 426 to mix with the fuel at upstream end 416 of burner tube 412. Combustion of the fuel and fresh air occurs downstream of the burner tip 420. Fresh secondary air enters secondary chamber 432 through dampers 434.

In order to recirculate flue gas from the furnace to the primary air chamber, a flue gas recirculation passageway 476 is formed in furnace floor 414 and extends to primary air chamber 426, so that flue gas is mixed with fresh air drawn into the primary air chamber from opening 480, through dampers 428. Flue gas containing, for example, 0 to about 15% $O_2$ is drawn through passageway 476 by the inspirating effect of fuel passing through venturi portion 419 of burner tube 412. Primary air and flue gas are mixed in primary air chamber 426, which is prior to the zone of combustion.

Optionally, one or more steam injection tubes 484 may be provided so as to be positioned in the direction of flow so as to add to the motive force provided by venturi portion 419 for inducing the flow of fuel, steam and flue gas, air and mixtures thereof into the burner tube 412.

In operation, a fuel orifice 411, which may be located within gas spud 424, discharges fuel into burner tube 412, where it mixes with primary air, recirculated flue-gas or mixtures thereof. The mixture of fuel and recirculated flue-gas, primary air or mixtures thereof then discharges from burner tip 420. The mixture in the venturi portion 419 of burner tube 412 is maintained below the fuel-rich flammability limit; i.e. there is insufficient air in the venturi to support combustion. Secondary air is added to provide the remainder of the air required for combustion. The majority of the secondary air is added a finite distance away from the burner tip 420.

As with previous embodiments, means for injecting steam in the form of de$NO_x$ steam injection tube(s) 453 are located in the passageway 476 upstream of the primary air dampers 428. This location results in a more homogenous mixture of flue gas, steam and air entering the burner venturi 419. A more homogeneous mixture results in higher venturi capacity, higher flue gas entrainment capacity, lower flame temperature and lower $NO_x$. This location also tends to reduce the temperature of the metallic FGR duct, which extends the life of the duct.

EXAMPLES

Example 1

This example explores the advantages of a burner of the type depicted in FIGS. 4 and 5, as modeled based on material balance calculations. The following burner condition was studied: fuel rate=255 lb./hr of methane fuel gas, with a fuel pressure upstream of the fuel orifice of 35–50 psig. The fuel orifice/gas spud is preferably of the type disclosed in Patent Application Ser. No. 10/389,328, filed Mar. 14, 2003 by D. B. Spicer and G. Stephens for a Fuel Spud for High Temperature Burners, which application is hereby incorporated herein by reference.

A total of 5,063 lb/hr of air (dry basis) is consumed in the burner 100, permitting combustion of the fuel with a slight excess of air. A total of 914 lb/hr of air is drawn into the primary air chamber 110. Steam is injected at a rate of 120 lb/hr of steam is injected in the steam injection tube 118, and the steam pressure upstream of the spud 120 may be in the range 20–100 psig to generate a high velocity steam jet. A suitable typical pressure may be 40 psig.

The action of the high velocity steam jet in the FGR venturi section 116 would inspirate approximately 800 lb/hr of flue gas into the FGR duct 112, providing an FGR ratio of approximately 15%. The embodiments of the instant invention are designed to generate FGR ratios in the range 10–25%.

In a typical ethylene furnace application, the burner 100 generates a mixture of fuel, air, flue gas and steam in the venturi section 104. The oxygen concentration in the venturi section 104 is approximately 9% (dry volume basis) and the temperature in the venturi section 104 is approximately 700° F. The mixture in the venturi section 104 contains approximately 20% of the stoichiometric air requirement of the fuel.

The mixture in the venturi section 104 exits through a series of ports or holes in the burner tip 124. Initial combustion occurs downstream of a plurality of side ports 126, where the combination of air. in the venturi mixture, plus the air passing between the burner tip 124 and an annular tile 128 provides sufficient air for combustion for the fuel exiting the side ports 126. The majority of the fuel exits the burner tip 124 through a plurality of center ports 129, generating a high velocity air-fuel-steam jet projecting into the furnace 114. The mixture projecting into the furnace 114 is a fuel rich mixture of fuel (in this example methane) and air, diluted with flue gas and steam. Combustion occurs gradually as staged air from the staged air ports 130 mix with the air-fuel jet. FGR and steam also raise the total heat capacity, which lowers overall flame temperature, which, in turn, reduces $NO_x$.

Example 2

To further demonstrate the benefits of the present invention, a burner, of the type depicted in FIGS. 4 and 5 was tested. The fuel orifice/gas spud was the type disclosed in FIG. 5E of Patent Application Ser. No. 10/389,328, filed Mar. 14, 2003 by D. B. Spicer and G. Stephens for a Fuel Spud for High Temperature Burners. The burner of this example also employed flue gas recirculation of the type described in U.S. Pat. No. 5,092,761 (as depicted in FIG. 5) and was operated at a firing rate of 6 million BTU/hr., using a fuel gas comprised of 30% $H_2$/70% natural gas, without steam injection. A very stable flame was observed, with $NO_x$ emissions measured at 67 ppm.

Example 3

In this example, the burner of Example 2 was used. Once again, the burner employed flue gas recirculation of the type described in U.S. Pat. No. 5,092,761 and was operated at a firing rate of 6 million BTU/hr., using a fuel gas comprised of 30% $H_2$/70% natural gas, with steam injected to the FGR duct (only) at a rate of 143 lb./hr. A very stable flame was observed, with $NO_x$ emissions measured at 42 ppm.

Example 4

Again, the burner of Example 2 was used, employing flue gas recirculation of the type described in U.S. Pat. No. 5,092,761. The burner was operated at a firing rate of 6 million BTU/hr., using a fuel gas comprised of 30% $H_2$/70% natural gas, with steam injected in the region of the burner tube venturi (only) at a rate of 143 lb./hr. A very stable flame was observed, with $NO_x$ emissions measured at 37 ppm.

Although the burners of this invention have been described in connection with floor-fired hydrocarbon cracking furnaces, they may also be used in furnaces for carrying out other reactions or functions.

Thus, it can be seen that, by use of this invention, $NO_x$ emissions may be reduced in a burner. The flue gas recirculation system of the invention can also easily be retrofitted to existing burners.

It will also be understood that the steam injection techniques described herein also has utility in traditional raw gas burners and raw gas burners having a pre-mix burner configuration wherein flue gas alone is mixed with fuel gas at the entrance to the burner tube. In fact, it has been found that the pre-mix, staged-air burners of the type described in detail herein can be operated with the primary air damper doors closed, with very satisfactory results.

Although the invention has been described with reference to particular means, materials and embodiments, it is to be understood that the invention is not limited to the particulars disclosed and extends to all equivalents within the scope of the claims.

What is claimed is:

1. A burner, said burner being located adjacent a first opening in a furnace, said burner comprising:

(a) a primary air chamber having a source of air;

(b) a burner tube including a downstream end, an upstream end for receiving fuel and flue gas, air and mixtures thereof from said primary air chamber, a burner tip mounted on the downstream end of said burner tube adjacent the first opening in the furnace, so that combustion of the fuel gas takes place downstream of said burner tip;

(c) at least one passageway having a first end at a second opening in the furnace and a second end opening into said primary air chamber, said primary air chamber being in fluid communication with the upstream end of said burner tube;

(d) means for drawing flue gas from said furnace, through said passageway and into said primary air chamber; and (e) means for injecting steam into said at least one passageway, said means for injecting steam located upstream of said source of air, wherein the location of said means for injecting steam is effective to reduce the temperature of said at least one passageway.

2. The burner according to claim 1, further comprising a fuel orifice located adjacent said upstream end of said burner tube for introducing fuel into said burner tube.

3. The burner according to claim 2, wherein said fuel orifice is located within a gas spud.

4. The burner according to claim 1, wherein the burner is a flat-flame burner.

5. The burner according to claim 1, wherein said at least one passageway comprises an external FGR duct.

6. The burner according to claim 2, wherein said means for drawing flue gas from said furnace, through said passageway and into said primary air chamber acts in response to an inspirating effect of uncombusted fuel exiting said fuel orifice, said uncombusted fuel flowing through said burner tube from its upstream end towards its downstream end, whereby the flue gas is mixed with air at said upstream end of said burner tube prior to the zone of combustion of the fuel and air.

7. The burner according to claim 6, further comprising at least one air opening spaced from said at least one passageway and opening into the furnace, and arranged to allow uncombusted air to be passed therethrough into said furnace.

8. The burner according to claim 7, wherein said means for drawing flue gas from said furnace comprises a venturi portion in said burner tube.

9. The burner according to claim 1, wherein said means for drawing flue gas from said furnace comprises a venturi portion in said burner tube.

10. The burner according to claim 1, wherein said at least one passageway having a first end at a second opening in the furnace and a second end opening into said primary air chamber includes a venturi portion in said at least one passageway.

11. The burner according to claim 10, wherein said venturi portion in said at least one passageway is located downstream of said means for injecting steam into said at least one passageway.

12. The burner according to claim 11, wherein said means for injecting steam is effective to increase inspiration of the flue gas.

13. The burner according to claim 1, further comprising at least one first adjustable damper opening into said primary air chamber to restrict the amount of air entering into said primary air chamber, and thereby to provide a vacuum to draw flue gas from the furnace.

14. The burner according to claim 1, further comprising a secondary air chamber and at least one second adjustable damper opening into said secondary air chamber to restrict the amount of air entering into said secondary air chamber, said secondary air chamber being in fluid communication with at least one air opening.

15. The burner according to claim 14, wherein said secondary air chamber is in fluid communication with a plurality of said at least one air opening.

16. A method for combusting fuel in a burner, said burner being located adjacent a first opening in a furnace, said method comprising the steps of:

(a) combining fuel and flue gas, air or mixtures thereof at a predetermined location;

(b) passing the fuel and air through a venturi;

(c) combusting said fuel at a combustion zone downstream of said venturi;

(d) drawing flue gas from the furnace through at least one passageway to a primary air chamber containing said predetermined location the primary air chamber having a source of air; and (e) injecting steam into said at least one passageway upstream of the source of air.

wherein the steam is effective to reduce the temperature of the at least one passageway.

17. The method according to claim 16, further comprising adjustably dampening flow of air to said primary air chamber.

18. The method according to claim 16, wherein the burner further comprises a secondary air chamber, said method further comprising the step of adjusting the flow of air to the secondary air chamber.

19. The method according to claim 16, wherein the furnace is a steam-cracking furnace.

20. The method according to claim 18, wherein said secondary air chamber is in fluid communication with at least one air opening.

21. The method according to claim 16, wherein said step of injecting steam is effective to increase inspiration of flue gas.

* * * * *